US009326072B2

(12) United States Patent
Tse et al.

(10) Patent No.: US 9,326,072 B2
(45) Date of Patent: Apr. 26, 2016

(54) WEARABLE SPEAKER SYSTEM WITH SATELLITE SPEAKERS AND A PASSIVE RADIATOR

(71) Applicant: Plastoform Industries Limited, Kwai Chung (HK)

(72) Inventors: Kin Man Tse, Kwai Chung (HK); Chi Hung Matthew Chan, Kwai Chung (HK)

(73) Assignee: Plastoform Industries Limited, Kwai Chung (HK)

( * ) Notice: Subject to any disclaimer, the term of this patent is extended or adjusted under 35 U.S.C. 154(b) by 95 days.

(21) Appl. No.: 14/152,973

(22) Filed: Jan. 10, 2014

(65) Prior Publication Data

US 2014/0126760 A1 May 8, 2014

Related U.S. Application Data

(63) Continuation-in-part of application No. 13/298,745, filed on Nov. 17, 2011, now Pat. No. 8,818,013.

(51) Int. Cl.

| | |
|---|---|
| ***H04R 1/02*** | (2006.01) |
| ***H04R 5/02*** | (2006.01) |
| *H04R 25/00* | (2006.01) |
| *H04R 1/10* | (2006.01) |
| *H04R 1/28* | (2006.01) |

(52) U.S. Cl.

CPC ..... *H04R 5/02* (2013.01); *H04R 1/1033* (2013.01); *H04R 1/2834* (2013.01)

(58) Field of Classification Search

CPC .... H04R 1/1075; H04R 1/1028; H04R 1/008; H04R 1/1016; H04R 1/283; H04R 1/2815; H04R 5/0335

USPC ..... 381/349, 351, 345, 342, 337, 338, 370, 381/376, 380

See application file for complete search history.

(56) References Cited

FOREIGN PATENT DOCUMENTS

GB 2005957 A * 4/1979 ..... H04R 1/1066

* cited by examiner

*Primary Examiner* — Sunita Joshi

(74) *Attorney, Agent, or Firm* — Martine Penilla Group, LLP

(57) ABSTRACT

This application relates to a wearable speaker system with passive radiators and active driver speakers that are connected by tubes. Acoustic energy from each active driver speaker is projected through the tubes to each respective passive radiator, causing the passive radiators to vibrate and resonate in response to the acoustic energy to project the desired audible sounds to a user.

14 Claims, 9 Drawing Sheets

WEARABLE SPEAKER SYSTEM WITH SATELLITE SPEAKERS AND A PASSIVE RADIATOR

CROSS REFERENCE TO RELATED APPLICATIONS

This application is a continuation-in-part (CIP) of U.S. patent application Ser. No. 13/298,745 filed on 17 Nov. 2011, the disclosure of which is incorporated herein by reference for all purposes.

FIELD OF THE INVENTION

This invention relates to a wearable speaker system. More particularly, this invention relates to a speaker system with a passive radiator and an active driver speaker that are connected by a flexible tube. Still more particularly, this invention relates to a speaker system whereby acoustic energy from the active driver speaker is projected through the flexible tube to the passive radiator, causing the passive radiator to vibrate and resonate in response to the acoustic energy to project the desired audible sounds.

PRIOR ART

Passive radiators have been used in various speaker system configurations for the purposes of obtaining low-frequency responses that are comparable to low-frequency responses that are achieved by larger bulkier systems. The passive radiator resembles a regular speaker driver, but without the magnetic and electrical components. When a passive radiator is placed together with the speaker driver inside a sealed enclosed speaker system, the fluctuating air pressure generated from the physical movement of the speaker driver causes the diaphragm of the passive radiator to vibrate and resonate. The vibration and resonance of the diaphragm creates low frequency sounds. Hence, by using a passive radiator, a smaller speaker system configuration is able to produce a low frequency response with the clarity and performance of larger speaker systems.

The use of a passive radiator in speaker systems enables the air pressure projected by the rear of a driver speaker to be utilized for an enhanced low-frequency response. In most cases, the low frequency response of a passive radiator is comparable to the response obtained by a ported enclosure. A ported enclosure enables the fluctuating air pressure generated by the driver speaker to move out of the enclosure, thus enhancing the efficiency of the driver speaker and altering the low-frequency output response. However, the movement of air through the port reduces the quality and definition of the resulting sound, requiring a larger volume of air to compensate for the air escaping through the port. Furthermore, as a ported tube occupies more space within a speaker box than a passive radiator, the occupation of the ported tube reduces the volume of air contained within the speaker box. Hence, by incorporating a passive radiator into a speaker box, the volume of usable acoustic generating air does not have to be sacrificed. In addition to the above, the bass quality of a speaker system is greatly improved when the fluctuating air pressure radiated by the driver speaker is concentrated on the diaphragm of the passive radiator. Since the fluctuating air pressure is neither lost nor wasted, the complete transfer of the acoustic energy from the active driver to the passive radiator achieves the sound quality and definition of both sealed and ported enclosures within a smaller volume of air.

Passive radiators in speaker systems are commonly enclosed together with the speaker driver(s) in a singular large housing. Such a construction is described in U.S. Pat. No. 4,350,847, as published on 21 Sep. 1982 in the name of Matthew S. Polk, and US Patent Publication Number 2001/0031061 A1, as published on 18 Oct. 2001 in the names of Coombs et al. This method of enclosing the speaker driver(s) together with the passive radiator in a single housing limits product miniaturization and design, especially since consideration has to be placed on the low-frequency performance of the speaker system. Therefore, there is a need for an improved design of a speaker system with passive radiators that does not compromise on the low-frequency performance whilst enabling the speaker design to be miniaturized and portable. This is of particular importance for the purpose of a wearable speaker system. Further, the aforementioned documents do not disclose of ways to optimize the low-frequency performance of the passive radiators.

Wearable speaker systems as described in the prior art are typically designed using hollow tubular ducts/cavities with active driver speakers, as described in U.S. Pat. No. 5,682,434, as published on 28 Oct. 1997 in the name of James H. Boyden, and in U.S. Pat. No. 7,035,422 B1, as published on 25 Apr. 2006 in the name of David Wiener. The hollow tubular ducts/cavities are made from a soft flexible material to ensure that the wearable speaker systems may be wrapped around the body in comfortable manner. The wearable speaker systems described in these documents are disadvantageous as the bass response of such speaker systems are inferior compared to the bass response of larger systems. A way to address this issue would be to add a passive radiator to the described speaker systems. However, when a passive radiator utilizes hollow tubular ducts/cavities as described in the documents above to transfer the acoustic energy radiating from the active driver speakers, the bass produced would be of a low quality due to losses caused by vibrations in the hollow tubular ducts/cavities. The flexible material used to construct the hollow tubular ducts/cavities will absorb the acoustic energy through various loss mechanisms such as vibrations, tonality and motion resulting in a poor quality low frequency response.

Therefore, for the purposes of a wearable speaker system, those skilled in the art are constantly looking for ways to address and to prevent pinching of the duct without compromising on the quality of the bass of the speaker system.

SUMMARY OF INVENTION

The above and other problems in the art are solved and an advance in the art is made in accordance with this invention. A first advantage of a speaker system in accordance with this invention is that this wearable speaker system with active driver speakers and a passive radiator is portable and may be worn on a body. A second advantage of a wearable speaker system in accordance with this invention is that the sound quality of the wearable speaker system is comparable, if not better than the sound quality of larger speaker systems. A third advantage of a wearable speaker system in accordance with this invention is that when the flexible ducts of the speaker are wrapped around the body, the performance of the speaker system will not be compromised as the flexible ducts are protected by flexible sleeves.

In accordance with another embodiment of this invention, a wearable speaker system in accordance with this invention comprises a first housing for a passive radiator having an opening. The passive radiator is located in the first housing. A second housing for an active driver speaker has a first opening and a second opening. A first end of a flexible duct seals the opening of the first housing and a second end of the flexible duct seals the first opening of the second housing. A flexible sleeve encloses the flexible duct to prevent the flexible duct from pinching off or collapsing when bent. An active driver speaker seals the second opening of the second housing. Acoustic energy projected from the rear of the active driver speaker is directed towards the passive radiator through the flexible duct.

In accordance with another embodiment of this invention, the flexible duct of the wearable speaker system comprises multilayered tubes that minimize airflow resistance and increase compressed air flow capacity through the flexible duct.

In accordance with an embodiment of this invention, the flexible sleeve of the wearable speaker system is a coiled spring that surrounds the flexible duct. In accordance with another embodiment of this invention, the flexible sleeve is a rotating friction chain that surrounds the flexible duct.

In accordance with an embodiment of this invention, the flexible duct has a stiffness that may handle an internal air pressure up to 0.18 Pascal without any surface deformation or expansion/deduction.

In accordance with an embodiment of this invention, the compressed air mass of the passive radiator housing, the active driver housing, and the first flexible duct is optimized to produce low frequency acoustic resonance. The compressed air mass within these components is in the range between 0 Pascal and 31.46 Pascal.

In accordance with an embodiment of this invention, a power supply unit is located at the passive radiator housing. A plurality of cables connects the power supply unit to the active driver in the wearable speaker system. The plurality of cables may be laid within the flexible duct, hidden away from the user.

In accordance with another embodiment of this invention, the power supply unit is located at the active driver speaker housing. A plurality of cables connects the power supply unit to the active driver. The plurality of cables may be laid within the flexible duct, hidden away from the user.

In accordance with another embodiment of this invention the passive radiator comprises a diaphragm that covers an entire side of the passive radiator housing.

In accordance with yet another embodiment of this invention, the passive radiator housing has a second opening, and there is a second active driver speaker housing with a first opening and a second opening. A first end of a second flexible duct seals the second opening of the passive radiator housing and a second end of the second flexible duct seals the first opening of the second active driver speaker housing. A second flexible sleeve encloses the second flexible duct wherein the second flexible sleeve prevents the second flexible duct from pinching off or collapsing. A second active driver seals the second opening of the second active driver housing wherein acoustic energy from the second active driver is projected to the passive radiator through the second flexible duct.

In accordance with an embodiment of this invention, the second flexible duct of the wearable speaker system comprises multilayered tubes that minimize airflow resistance and increases compressed air flow capacity through the flexible duct.

In accordance with an embodiment of this invention, the second flexible sleeve of the wearable speaker system comprises either a coiled spring that surrounds the flexible duct or a rotating friction chain that surrounds the flexible duct.

In accordance with an embodiment of this invention, the second flexible duct has a stiffness may handle an internal air pressure up to 0.18 Pascal without any surface deformation or expansion/deduction.

In accordance with an embodiment of this invention, the compressed air mass of the passive radiator housing, the active driver housing, and the first and second flexible ducts is optimized to produce low frequency acoustic resonance. The compressed air mass within these components is in the range between 0 Pascal and 31.46 Pascal.

In accordance with an embodiment of this invention, a power supply unit is located at the passive radiator housing. A plurality of cables connects the power supply unit to the active drivers in the wearable speaker system. The plurality of cables may be laid within the first and second flexible ducts, hidden away from the user.

In accordance with another embodiment of this invention, the power supply unit is located at the second active driver speaker housing. A plurality of cables connects the power supply unit to the active drivers. The plurality of cables may be laid within the first and second flexible ducts, hidden away from the user.

In accordance with yet another embodiment of this invention, the wearable speaker system comprises a first passive radiator and a first active driver pair wherein the first passive radiator is disposed within a first housing, the first active driver is disposed within a second housing and a first duct acoustically connects the first passive radiator to the first active driver. The system also comprises a second passive radiator and a second active driver pair wherein the second passive radiator is disposed within a fourth housing, the second active driver is disposed within a third housing and a second duct acoustically connects the second passive radiator to the second active driver. In addition to the above, the system also comprises a third duct acoustically connecting the first pair to the second pair. The first active driver is configured to project acoustic energy to the first passive radiator and to the second passive radiator. Similarly, the second active driver is configured to project acoustic energy to the second passive radiator and to the first passive radiator.

In accordance with a further embodiment of the invention, the wearable speaker system further comprises a first flexible sleeve that encloses the third duct wherein the first flexible sleeve is provided with means for preventing the third duct from pinching off or collapsing. In an embodiment of this invention, the means for preventing the third duct from pinching off or collapsing comprises a coiled spring surrounding the third duct. In accordance with another embodiment of the invention, the means comprises a rotating friction chain surrounding the third duct.

In accordance with yet another embodiment of the invention, the first, second and third ducts of the wearable speaker system comprise multilayered tubes for minimizing airflow resistance and for increasing compressed airflow capacity through the flexible ducts.

In accordance with another embodiment of the invention, the wearable speaker system further comprises a second flexible sleeve enclosing the first duct wherein the second flexible sleeve is provided with means for preventing the first duct from pinching off or collapsing. In an embodiment of this invention, the means for preventing the first duct from pinching off or collapsing comprises a coiled spring surrounding the first duct.

In accordance with another embodiment of the invention, the wearable speaker system further comprises a third flexible sleeve enclosing the second duct wherein the third flexible sleeve is provided with means for preventing the second duct from pinching off or collapsing. In an embodiment of this invention, the means for preventing the second duct from pinching off or collapsing comprises a coiled spring surrounding the second duct.

In accordance with another embodiment of the invention, the third duct acoustically connects the second housing to the third housing. In yet another embodiment of the invention, the third duct acoustically connects the first housing to the fourth housing.

In accordance with an embodiment of the invention, a first power supply unit is located either in the first housing, the second housing, or in the third housing. In accordance with a further embodiment of this invention, a second power supply unit is located in the fourth housing.

In accordance with another embodiment of the invention, the first passive radiator further comprises a diaphragm that covers a side of the first housing or the second passive radiator further comprises a diaphragm that covers a side of the fourth housing.

In accordance with another embodiment of the invention, the first duct, the second duct and the third duct comprises a flexible duct, a rigid duct or a passageway.

BRIEF DESCRIPTION OF THE DRAWINGS

The above advantages and features of a method and apparatus in accordance with this invention are described in the following detailed description and are shown in the drawings.

DETAILED DESCRIPTION

This invention relates to a wearable speaker system. More particularly, this invention relates to a speaker system with a passive radiator and an active driver speaker that are connected by a flexible tube. Still more particularly, this invention relates to a speaker system whereby acoustic energy from the active driver speaker is projected through the flexible tube to the passive radiator, causing the passive radiator to vibrate and resonate in response to the acoustic energy to project the desired acoustics.

Figure 1:
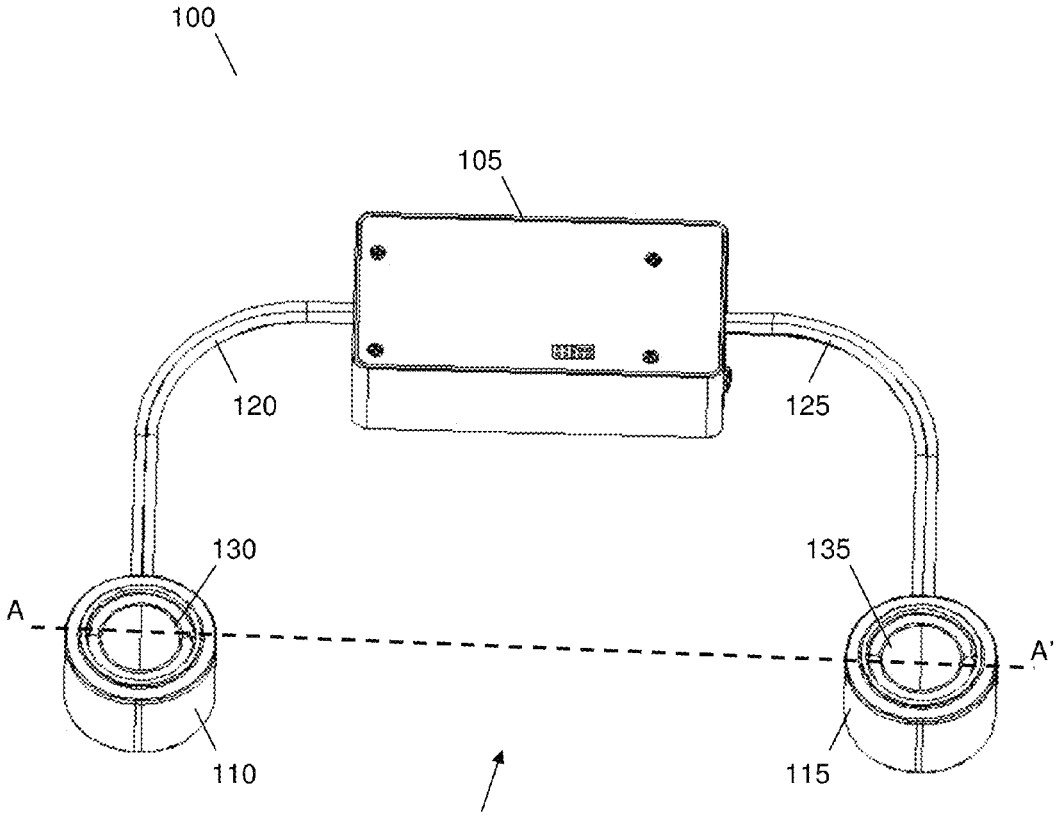
FIG. 1 illustrating a wearable speaker system in accordance with an embodiment of this invention.

Wearable speaker system 100, shown in FIG. 1, is a speaker system in accordance with an embodiment of this invention. FIG. 1 illustrates passive radiator housing 105, active driver speaker housings 110,115, and flexible ducts 120,125. Active driver speaker 130 is located within active driver speaker housing 110 and second active driver speaker 135 is located within active driver speaker housing 115. A passive radiator (not shown) is located in passive radiator housing 105. One skilled in the art will recognize that the passive radiator may be integral to; located within; part of; or connected to; passive radiator housing 105 by any means without departing from this invention. Flexible duct 120 is connected at one end to an opening in passive radiator housing 105 and is connected at another end to an opening in active driver speaker housing 110. Similarly, flexible duct 125 is connected at one end to another opening in passive radiator housing 105 and is connected at another end to an opening in active driver speaker housing 115. Both ends of each of flexible ducts 120,125 are hermetically sealed to the respective housings to ensure that air does not leak from the respective openings. In operation, acoustic energy generated by active driver speakers 130,135 is projected through flexible ducts 120,125 respectively to passive radiator housing 105. The projected acoustic waves are summed in passive radiator housing 105 and transferred to the passive radiator. The summed acoustic energy causes the diaphragm of the passive radiator to vibrate and resonate, producing a low frequency response. One skilled in the art will recognize that although two active speaker drivers are shown in this embodiment, the invention may comprise of various active driver speaker combinations, for example one or more than two active speaker drivers.

Figure 2:
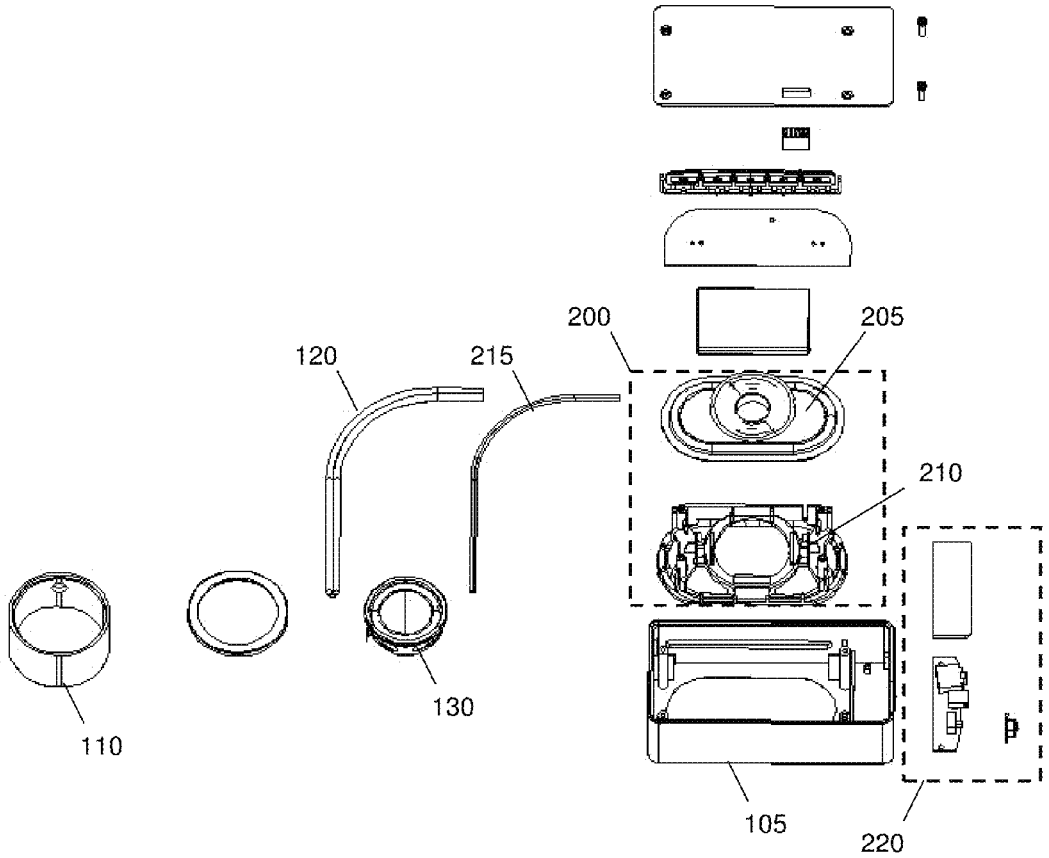
FIG. 2 illustrating an exploded view of a wearable speaker system in accordance with an embodiment of this invention.

FIG. 2 illustrates an exploded view of wearable speaker system 100. Only active driver speaker 130, active driver speaker housing 110, flexible duct 120 are shown in this figure for brevity. One skilled in the art will recognize that when a plurality of active driver speakers in accordance with this invention is provided, the inner configurations of each of the active driver speaker may be similar as that shown in FIG. 2. This figure also shows passive radiator 200 that comprises passive radiator diaphragm 205 and passive radiator surround 210. The size of passive radiator diaphragm 205 is limited by the size of passive radiator housing 105. In this embodiment, the size of passive radiator diaphragm 205 is similar in size as the larger side of passive radiator housing 105. There is a trade-off between the sound quality of the passive radiator and the portability of the wearable speaker system. Hence, the size of passive radiator 200 is determined by the largest surface area of passive radiator housing 105. In this embodiment, power supply unit 220 is located within passive radiator housing 105. Electrical cable 215 within flexible duct 120 connects power supply unit 220 to active driver speaker 130. One skilled in the art will recognize that power supply unit 220 may be located within active driver speaker housing 110 or any other active driver speaker housings without deviating from this invention. Power supply unit 220 may comprise batteries, an A/C power supply unit or various other types of power sources.

Figure 3:
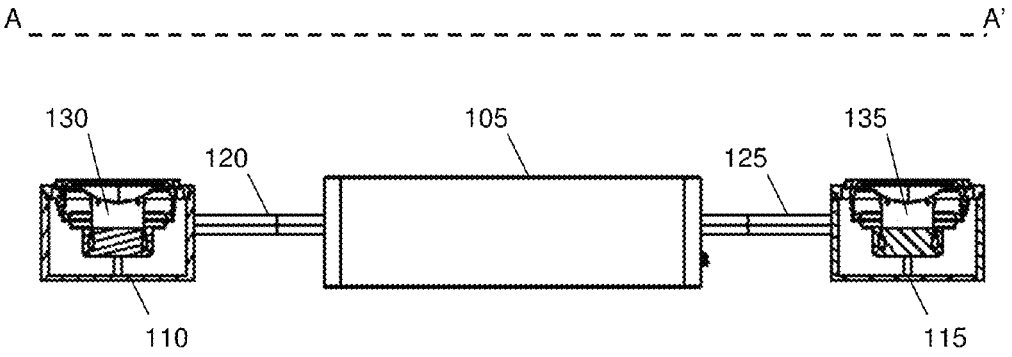
FIG. 3 illustrating a cross sectional frontal view of two active drivers in accordance with line A-A' of a wearable speaker system as shown in FIG. 1
Figure 4:
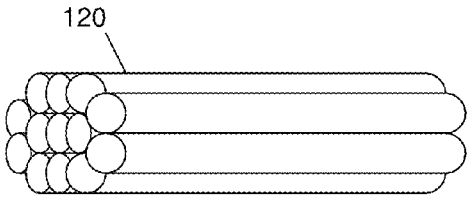
FIG. 4 illustrating a multilayered flexible duct in accordance with an embodiment of this invention.

FIG. 3 illustrates a cross sectional frontal view of active driver speakers 130,135, active driver speaker housings 110, 115 and passive radiator housing 105 along line A-A1 of wearable speaker system 100. The material for flexible ducts 120,125 are chosen such that flexible ducts 120,125 are sufficiently rigid while being sufficiently flexible to ensure that flexible ducts 120,125 may be worn around a body. Flexible ducts 120,125 must be sufficiently rigid to ensure that flexible ducts 120,125 are able to transfer the acoustic waves in the form of compressed and expanded air from active driver speaker 130,135 to passive radiator 200 with minimal loss. If flexible ducts 120,125 are not sufficiently rigid; the acoustic energy from active driver speakers 135,135 will be lost in the form of structural vibrations. Structural vibrations and absorption in flexible ducts 120,125 create various colorations and distortions, causing the acoustic energy being transferred to degrade and fade. As a result, the acoustical energy transmitted to passive radiator 200 is greatly reduced, causing passive radiator 200 to produce an unsatisfactory low frequency response. The rigidity or stiffness of flexible ducts 120,125 may be altered by varying the length, thickness, and diameter of the flexible ducts. However, when the rigidity of flexible ducts 120,125 increases, the flexibility of these ducts decreases. This trade-off between rigidity and flexibility is disadvantageous in a design whereby the ducts have to be sufficiently flexible to ensure that they may be worn around the body. Hence, to address this issue, embodiments in accordance with this invention include flexible ducts 120,125 with a stiffness that may handle an internal air pressure up to 0.18 Pascal without surface deformation or expansion/deduction. This range of stiffness in flexible ducts 120, 125 were achieved by using flexible material such as PVC, PET, etc. Additionally, the stiffness or rigidity of the ducts may be improved by selecting ducts with smaller diameters, e.g. around 2 mm. However, when the diameters of the ducts are reduced, this reduces the air mass flow-able within the ducts. In order to solve this issue, multi-layered ducts may be used (as shown in FIG. 4). In another embodiment, ducts formed by ball joints may used to achieve flexible ducts 120, 125. These ball jointed ducts (not shown) are able to achieve the required stiffness while being sufficiently flexible to be worn on the body.

As mentioned briefly above, one skilled in the art will recognize that a flexible and sufficiently rigid duct for transporting acoustic energy may be achieved by using a duct with a smaller diameter. However, such a duct will compromise the low frequency performance of the wearable speaker system. In order for passive radiator 200 to be efficiently and effectively driven by the acoustic energy projected from active driver speakers 130,135, the size and diameter of flexible ducts 120,125 should be of a sufficient size to ensure that air projected from the rear of active driver speakers 130,135 flows smoothly to the passive radiator without any resistance from flexible ducts 120, 125. However, when the size of flexible ducts 120,125 increases, the rigidity of the ducts degrades, which in turn degrades the quality of the low frequency response. In addition, the volume of air within the ducts must be of a sufficient mass to ensure that all the acoustic energy may be transferred instantaneously. When the volume of air within the duct is reduced, a bottleneck will occur at the duct with the smaller diameter whereby most of the acoustic energy will be reflected back towards the respective active driver speaker as the volume of air within the flexible duct will be unable to accommodate the amount of acoustic energy being radiated. The reflected acoustic energy, which may be out of phase with the acoustic energy radiating from the active driver speaker, may interfere with the acoustic energy radiating from the active driver speaker resulting in acoustical losses causing a weak bass response.

If the rigidity and the stiffness of the duct is too low, deformation, expansion, deduction of the duct may occur causing the duct to absorb most of the generated acoustical energy being transferred by the air mass. As a result, the amount of acoustical energy transferred by the air mass will be insufficient to activate the passive radiator. To overcome these problems, flexible ducts 120,125 may be designed using multilayered tubes as shown in FIG. 4. The multilayered tubes ensure that air projected from the rear of active driver speakers 130,135 will not encounter any resistance while ensuring that flexible ducts 120,125 are sufficiently rigid to avoid any structural vibration issues. The volume of air between the active driver speaker and the passive radiator will also be increased by the use of flexible ducts with multilayered tubes thus avoiding any bottleneck issues.

Figure 5:
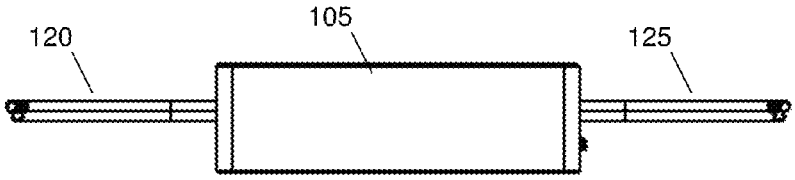
FIG. 5 illustrating a frontal view of a passive radiator enclosure of a wearable speaker system in accordance with an embodiment of this invention.

FIG. 5 illustrates passive radiator housing 105 with flexible ducts 120,125. In FIG. 5, flexible ducts 120,125 are hermetically sealed to passive radiator housing 105. Flexible ducts 120,125 must be hermetically sealed to passive radiator housing 105 and to active driver speaker housings 110,115 to ensure that air does not leak out when active driver speakers 130,135 are in operation. If any leaks occur, this will cause the low frequency response of passive radiator 200 to degrade as the projected acoustic energy will leak as well. As a result, there will be insufficient acoustic energy to cause the diaphragm of passive radiator 200 to vibrate and resonate properly. Flexible ducts 120,125 may be sealed using various methods commonly known in the art. Such methods shall not be covered in this document for brevity.

Figure 6:
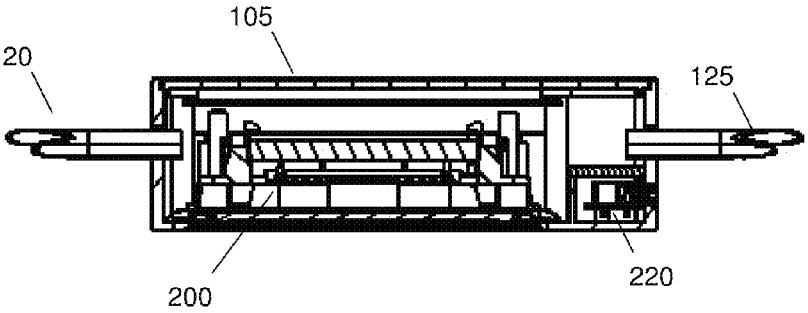
FIG. 6 illustrating a frontal internal view of a passive radiator of a wearable speaker system in accordance with an embodiment of this invention.

FIG. 6 illustrates a frontal internal view of passive radiator housing 105 comprising passive radiator 200 and power supply unit 220. Flexible ducts 120,125 direct acoustic energy from active driver speakers 130,135 to passive radiator 200. The ends of flexible ducts 120,125 in passive radiator housing 105 are arranged such, to allow the acoustic energy to be directly projected onto passive radiator 200, unimpeded by any components. This ensures that the acoustic energy does not encounter any resistance from any components in passive radiator housing 105. Power supply unit 220 is shown in this figure to be arranged such that power supply unit 220 is located out of the exit path of flexible duct 125. A plurality of cables (not shown) connect power supply unit 220 to active driver speakers 130,135. The plurality of cables may be laid within flexible ducts 120,125 in such a manner that the cables do not interfere with the flow of air within these flexible ducts.

When flexible ducts 120,125 are worn around a body, these ducts may pinch-off or collapse when bent. Under such conditions, the amount of acoustic energy transferred to passive radiator 200 will be greatly compromised as acoustic reflections may occur at these bends. To prevent such a situation from occurring, flexible sleeves 710,715 are used to enclose flexible ducts 120, 125.

Figure 7:
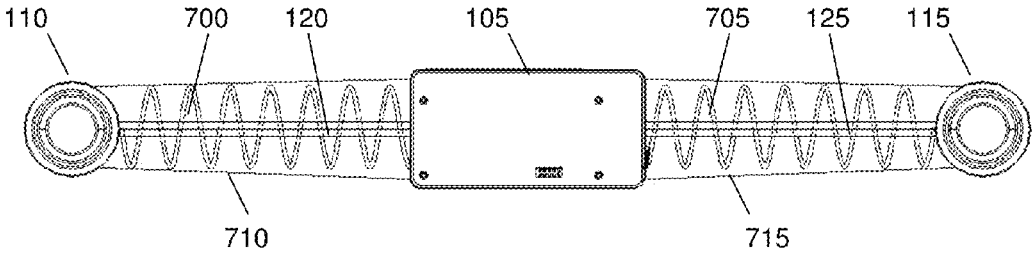
FIG. 7 illustrating a flexible sleeve with a coiled spring surrounding the flexible ducts.

In the embodiment shown in FIG. 7, flexible sleeves 710, 715 comprise coiled springs 700,705 that surround flexible ducts 120,125. Coiled springs 700,705 together with flexible sleeves 710,715 form a gap surrounding flexible ducts 120, 125. It is this gap that prevents flexible ducts 120,125 from collapsing or pinching-off when bent. One skilled in the art will recognize that other elastic or coiled means may be used to replace coiled springs 700,705 without departing from this invention.

Figure 8:
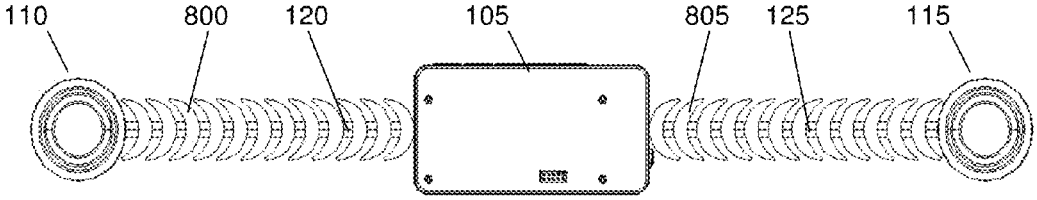
FIG. 8 illustrating a flexible sleeve with a rotating friction chain surrounding the flexible ducts.

In another embodiment, flexible sleeves 710,715 are replaced with a rotating friction chain as shown in FIG. 8. Rotating friction chains 800,805 perform the similar function as coiled springs 700,705. "C" shaped folding hinge sections link together to form rotating friction chains 800,805. Rotating friction chains 800, 805 encompass flexible ducts 120, 125. The "C" shape in the links prevents flexible ducts 120, 125 from being bent beyond a particular angle to ensure that the transfer of acoustic energy from the active driver speakers to the passive radiator is never compromised by collapsing ducts. One skilled in the art will recognize that other types of chains or links may be used to replace rotating friction chains 800,805 without departing from this invention.

Another factor which determines the sound quality of wearable speaker system 100 is the mass of air contained within this system. A larger mass of air will cause passive radiator 200 to produce a better quality low frequency response. In an embodiment of this invention, the mass of air within this system is in the range between 0 Pascal and 31.46 Pascal.

Figure 9:
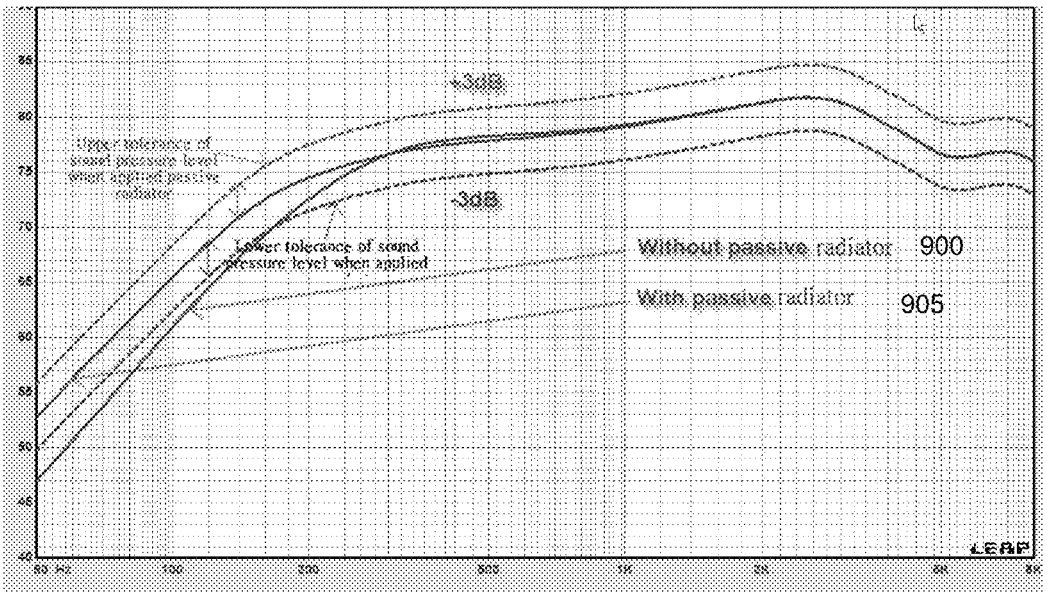
FIG. 9 illustrating the frequency response of a standard speaker configuration with an active driver and passive radiator together with the frequency response of a wearable speaker system in accordance with an embodiment of this invention.

FIG. 9 illustrates the frequency response of a standard active driver/passive radiator speaker configuration 900 together with the frequency response of a wearable speaker system in accordance with an embodiment of this invention 905. For the standard active driver/passive radiator speaker configuration, the active driver speaker and passive radiator are both contained within a single enclosure. The size of this enclosure is larger compared to the size of passive radiator housing 105 and active driver speaker housings 110, 115 combined. As shown at curves 900 and 905 in FIG. 9, the low frequency performance of wearable speaker system 100 is better than the low frequency performance of a standard active driver/passive radiator speaker configuration even though the overall size of wearable speaker system 100 is more compact and portable.

Wearable speaker system 100 has the advantage of being portable, flexible, and wearable, while exceeding the sound quality of larger and bulkier speaker systems.

Figure 10:
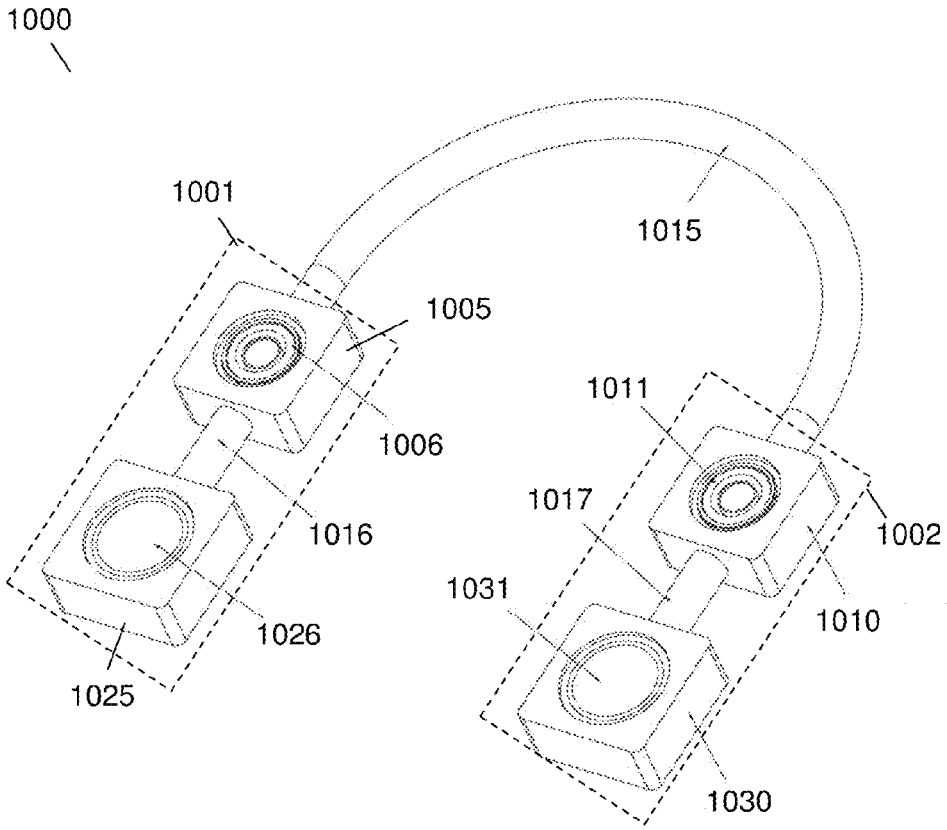
FIG. 10 illustrating a wearable speaker in accordance with another embodiment of this invention.

A wearable speaker in accordance with another embodiment of this invention is illustrated in FIG. 10. Wearable speaker system 100 as illustrated in FIG. 10 comprises passive radiator and active driver pair 1001 that is acoustically connected to passive radiator and active driver pair 1002 by duct 1015. Passive radiator and active driver pair 1001 further comprises housing 1025 and housing 1005, wherein active driver speaker 1006 is located within housing 1005 and passive radiator 1026 is disposed within housing 1025. Similarly, passive radiator and active driver pair 1002 further comprises housing 1030 and housing 1010, wherein active driver speaker 1011 is located within housing 1010 and passive radiator 1031 is disposed within housing 1030. One skilled in the art will recognize that the passive radiators may be integral to; located within; part of; or connected to; housings 1025, 1030 by any means without departing from this invention.

In accordance with another embodiment of this invention, active driver speaker 1006 is located within housing 1025 and active driver speaker 1011 is located within housing 1030. Passive radiators 1026, 1031 are disposed within housings 1005 and 1010 respectively. However, for the sake of brevity, for the rest of the description, reference will only be made to the configuration shown in FIG. 10 that is the configuration whereby the active driver speakers are located within housings 1005, 1010, and whereby the passive radiators are located within housings 1025, 1030.

One skilled in the art will recognize that the passive radiators and active speakers may be interchangeably disposed in housings 1025, 1005, 1010, or 1030 without departing from this invention. Further, one skilled in the art will recognize that the following descriptions may be applied to various passive radiator-active driver configurations of the invention without departing from the inventive concept of the invention.

Referring back to FIG. 10, it is illustrated that passive radiator and active driver pair 1001 is acoustically connected to passive radiator and active driver pair 1002 by duct 1015. Passive radiator and active driver pair 1001 comprise housings 1025 and 1005 while passive radiator and active driver pair 1002 comprise housings 1010 and 1030. Duct 1016 is connected at one end to an opening in housing 1025 and is connected at another end to an opening in housing 1005. Similarly, duct 1017 is connected at one end to an opening in housing 1030 and is connected at another end to an opening in housing 1010. In accordance with another embodiment of the invention, housing 1005 is acoustically connected to housing 1010 through duct 1015. Duct 1015 has an end that is connected to an opening in housing 1005 and has another end that is connected to an opening in housing 1010. The ends of each of ducts 1015, 1016, 1017 are hermetically sealed to the respective housings to ensure that air does not leak from the respective openings. In another embodiment of the invention, ducts 1016 and 1017 may comprise flexible ducts, rigid ducts or passageways. Passageways or rigid ducts are typically utilized when the separation between housings 1005 and 1025, or between housings 1010 and 1030 are close to each other. At such a distance, it is unlikely that ducts 1016, 1017 will bend therefore; this reduces the need for flexible ducts to be used.

In operation, acoustic energy generated by active driver speaker 1006 is projected to housing 1025 through duct 1016, to housing 1010 through duct 1015 and also to housing 1030 through ducts 1015 and 1017. At the same time, acoustic energy generated by active driver speaker 1011 is projected to housing 1030 through duct 1017, to housing 1005 through duct 1015 and also to housing 1025 through ducts 1015 and 1016. The projected acoustic waves are summed in their respective radiator housings and are subsequently transferred to their respective passive radiators. The summed acoustic energies causes each diaphragm of each passive radiator to vibrate and resonate, producing a low frequency response. This means that by individually controlling the acoustic energy generated by each of active drivers 1006 and 1011, the amount of bass generated by each of passive radiators 1026 and 1031 may be controlled individually as well.

For example, if active driver 1006 were to generate greater acoustic energy, that is if active driver 1006 were producing a louder sound, as compared to active driver 1011, the resonance of passive radiator 1026 would also be greater than the resonance of passive radiator 1031. Simply put, this would result in passive radiator 1026 producing a deeper and louder bass as compared to the bass generated by passive radiator 1031. This is because as the acoustic energy generated by active driver 1006 travels along ducts 1015, 017 and housing 1010 towards housing 1030, some of this energy is lost. This loss of energy may be caused by the energy being absorbed by the flexible ducts or by housing 1010 as the acoustic waves travel along this path. One skilled in the art will recognize that although two active speaker drivers and two passive radiators are shown in this embodiment, the invention may comprise of various active driver speaker and passive radiator configurations by increasing the number of housing and number of ducts accordingly.

Figure 11:
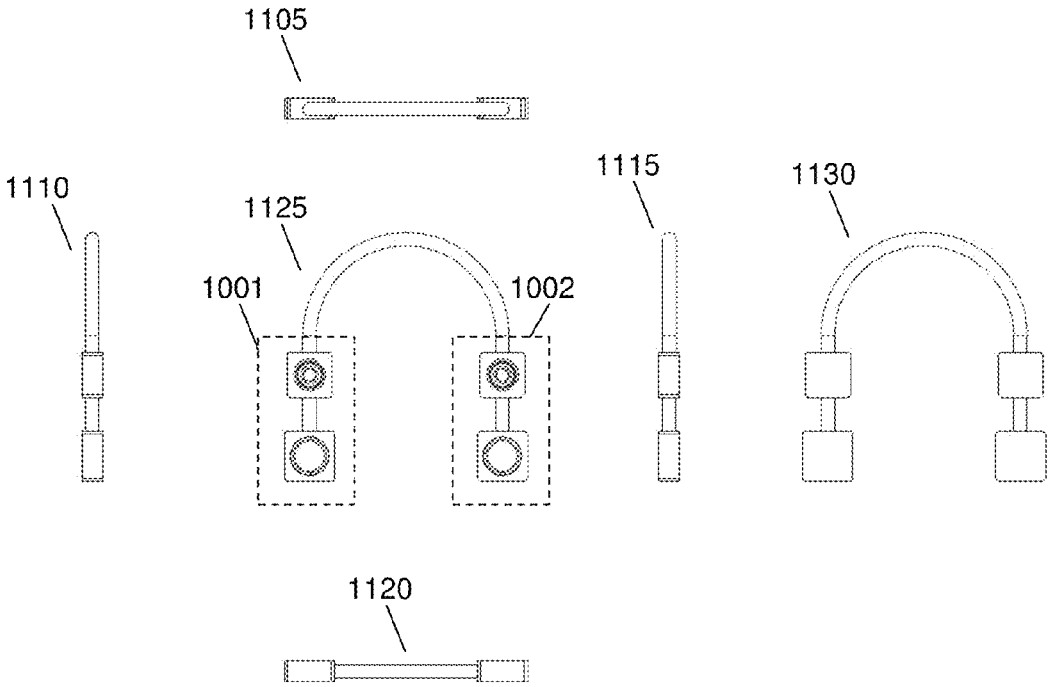
FIG. 11 illustrating various views of a wearable speaker in accordance with the embodiment shown in FIG. 10.

FIG. 11 illustrates various views of wearable speaker system 1000. The top view of wearable speaker system 1000 is illustrated as 1125, the side views are 1110 and 1115, and the frontal view is 1120. The view from the back looking towards flexible duct 1015 is illustrated as 1105 and the bottom view is 1130.

Figure 12:
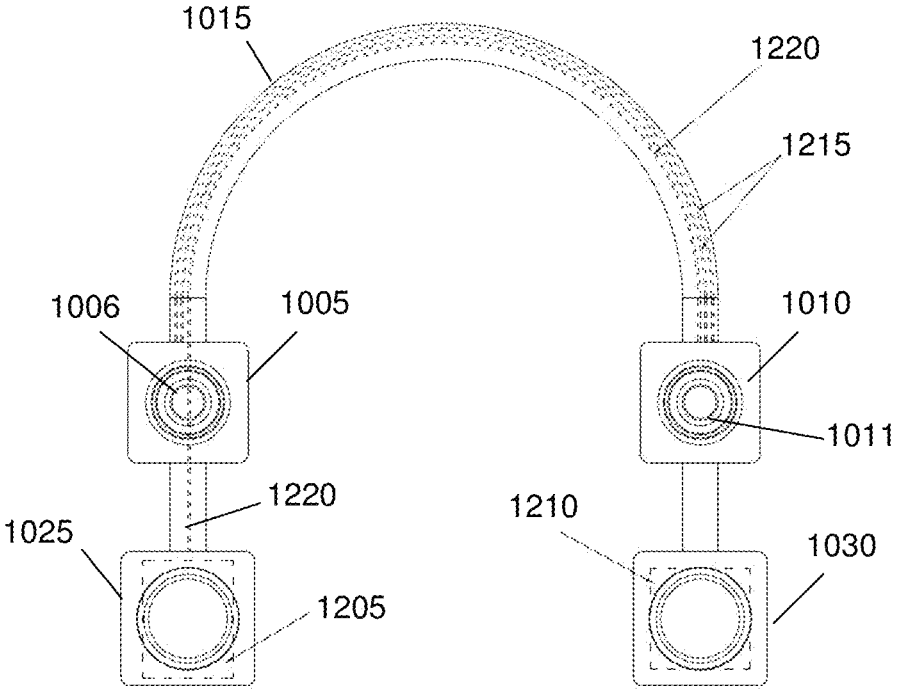
FIG. 12 illustrating the inner components contained within the wearable speaker shown in FIG. 10.

FIG. 12 illustrates some of the other components contained within wearable speaker system 1000. Power supply unit 1205 may be disposed within housing 1025 and/or housing 1030. An integrated circuit designed on printed circuit board 1210 (which is used to receive the signal from an external amplifier) may also be disposed within housing 1025 and/or housing 1030. In accordance with other embodiments of the invention, power supply unit 1205 may also be disposed within housing 1005 and/or housing 1010. Similarly, an integrated circuit designed on printed circuit board 1210 (which is used to receive the signal from an external amplifier) may also be disposed within housing 1005 and/or housing 1010.

As with the earlier embodiment, the sizes of each passive radiator's diaphragms are limited by the size of the housings for each respective passive radiator. In this embodiment, the size of each respective passive radiator diaphragm is similar in size as the larger side of passive radiator housings 1025 and 1030. There is a trade-off between the sound quality of the passive radiator and the portability of the wearable speaker system. Hence, the size of passive radiators 1026 and 1031 are determined by the largest surface area of housings 1025 and 1030 respectively. In this embodiment, power supply unit 1205 is illustrated as being disposed within housing 1025. Electrical cable 1220 that is encased within flexible ducts 1015, 1016, and 1017 connects power supply unit 1205 to active driver speakers 1006 and 1011. Power supply unit 1205 may comprise batteries, an A/C power supply unit or various other types of power sources. Audio cables 1215, which are sheathed within flexible duct 1015, connects active driver speaker 1006 to active driver speaker 1011.

Figure 13:
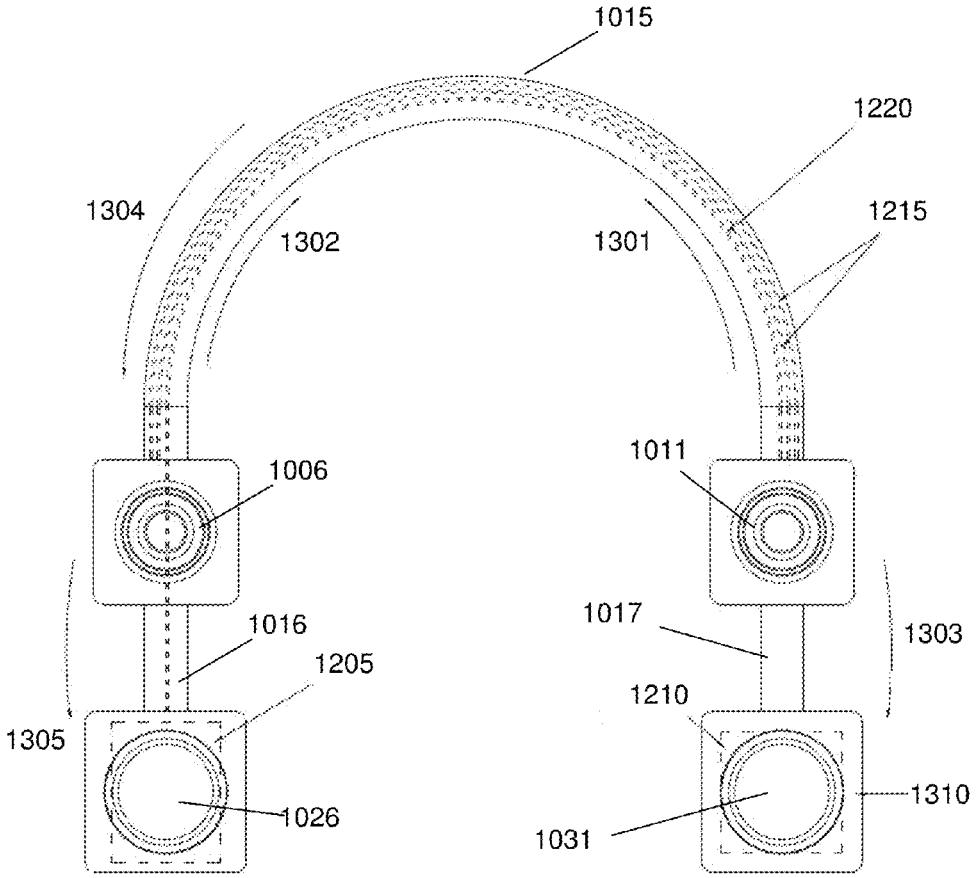
FIG. 13 illustrating the directions of the acoustic projections within the wearable speaker shown in FIG. 10.

FIG. 13 illustrates the acoustic projections that are generated by active driver speakers 1006 and 1011. When active driver speaker 1006 generates acoustic energy, this acoustical energy travels along duct 1016 towards passive radiator 1026 as illustrated by arrow 1305. At the same time, acoustic energy from active driver speaker 1006 is also projected in an opposite direction, traveling along ducts 1015, 1017 and housing 1010 towards passive radiator 1031 as illustrated by arrows 1302 and 1303. Similarly, when active driver speaker 1011 generates acoustical energy, this acoustical energy travels along duct 1017 towards passive radiator 1031 as illustrated by arrow 1303. At the same time, acoustic energy from active driver speaker 1011 is also projected in an opposite direction, traveling along ducts 1015, 1016 and housing 1005 towards passive radiator 1026 as illustrated by arrows 1301, 1304 and 1305. Audio signal 1310 may be transmitted wirelessly or through wired connections to wearable speaker system 1000. The various wireless transmission techniques and various wired connections have been omitted for brevity as such techniques are known to one skilled in the art.

When flexible ducts are used as ducts 1015, 1016 and 1017, the material for these ducts have to be such that ducts 1015, 1016 and 1017 are sufficiently rigid while being sufficiently flexible to ensure that flexible ducts 1015, 1016 and 1017 may be worn around a body. In an embodiment of this invention, as illustrated in FIGS. 11-13, flexible duct 1015 is much longer than flexible ducts 1016 and 1017 as flexible duct 1015 is to be worn around the shoulders of a user. Nevertheless, flexible ducts 1015, 1016 and 1017 must be sufficiently rigid to ensure that flexible ducts 1015, 1016 and 1017 are able to transfer the acoustic waves in the form of compressed and expanded air from active driver speakers 1006, 1011 to passive radiators 1026, 1031 with minimal loss. If flexible ducts 1015, 1016 and 1017 are not sufficiently rigid; the acoustic energy from active driver speakers 1006, 1011 will be lost in the form of structural vibrations. Structural vibrations and absorption in flexible ducts 1015, 1016 and 1017 create various colorations and distortions, causing the acoustic energy being transferred to degrade and fade. As a result, the acoustical energy transmitted to passive radiators 1026, 1031 will be greatly reduced, causing passive radiators 1026, 1031 to produce an unsatisfactory low frequency response. The rigidity or stiffness of flexible ducts 1015, 1016 and 1017 may be altered by varying the length, thickness, and diameter of the flexible ducts. However, when the rigidity of flexible ducts 1015, 1016 and 1017 increases, the flexibility of these ducts decreases. This trade-off between rigidity and flexibility is disadvantageous in a design whereby the ducts have to be sufficiently flexible to ensure that they may be worn around the body. Hence, to address this issue, embodiments in accordance with this invention include flexible ducts that use flexible material such as PVC, PET, etc. Additionally, the stiffness or rigidity of the ducts may be improved by selecting flexible ducts with smaller diameters, e.g. around 2 mm. However, when the diameters of the ducts are reduced, this reduces the air mass flow-able within the ducts. In order to solve this issue, multi-layered ducts may be used (as shown in FIG. 4). In another embodiment, ducts formed by ball joints may utilized as flexible ducts 1015, 1016 and 1017. These ball jointed ducts (not shown) are able to achieve the required stiffness while being sufficiently flexible to be worn on the body.

The following example illustrates a method used to determine the air mass required by a passive radiator in accordance with an embodiment of this invention. One skilled in the art will realize that the example set out below is not an exhaustive list of the embodiments of this invention.

EXAMPLE 1

In an embodiment of the invention, the wearable speaker system with a passive radiator is provided with the following specifications:

Surface area of the Passive Radiator: 0.00286 $m^2$
Mass of Passive Radiator: ~0.03 kg
Working frequency range: 80 Hz-500 Hz
Maximum frequency vibration: 0.004 meter The air mass receivable by a passive radiator at 500 Hz may be calculated as follows:

$$\text{Force} = \text{Mass} \times \text{Velocity}$$
$$0.03\ \text{kg} \times (500\ \text{Hz} \times 0.004\ \text{meters})$$
$$0.06\ \text{Newton}$$

$$\text{Air Mass over the passive radiator} = \text{Force}/\text{Area}$$
$$= 0.06\ N/0.00286\ \text{m}^2$$
$$= 20.97\ \text{N}/\text{m}^2$$
$$= 20.97$$

Under the assumption that there will be 50% production deviation, the Air Mass over the passive radiator = 20.97 Pa × 150%
= 31.455 Pascal In general, depending on the usage of the speaker system, the air mass receivable by a passive radiator may be altered by varying any of the parameters disclosed above.

EXAMPLE 2

Generally, the size of the passive radiator housing to the active driver housing may be apportioned as follows:

1.2×PRsn: 1×Dsn to 2.5×PRsn: 1 Dsn whereby: PRs: the vibration area of the passive radiator PRsn: the vibration area of the passive radiator×the quantity of the passive radiator Ds: the active driver's vibration area Dsn: the active driver's vibration area×the quantity of the active driver The above is a description of a wearable speaker system with satellite active driver speakers, passive radiators, and flexible ducts that are protected by flexible sleeves. It is foreseen that those skilled in the art can and will design alternative embodiments of this invention as set forth in the following claims.

The invention claimed is:

1. A wearable speaker system comprising:

a first passive radiator and a first active driver pair wherein, the first passive radiator is disposed within a first housing, the first active driver is disposed within a second housing, and a first duct acoustically connects the first passive radiator to the first active driver;

a second passive radiator and a second active driver pair wherein, the second active driver is disposed within a third housing, the second passive radiator is disposed within a fourth housing, and a second duct acoustically connects the second passive radiator to the second active driver;

a third duct acoustically connecting the first passive radiator and the first active driver pair, to the second passive radiator and the second active driver pair, wherein the first active driver is configured to project acoustic energy to the first passive radiator and to the second passive radiator; and wherein the second active driver is configured to project acoustic energy to the second passive radiator and to the first passive radiator, wherein the acoustic energy from the first and second active drivers are summed at the first housing and transferred to the first passive radiator, and the acoustic energy from the first and second active drivers are summed at the fourth housing and transferred to the second passive radiator.

2. The wearable speaker system according to claim 1 further comprising:

a first flexible sleeve enclosing the third duct wherein the first flexible sleeve is provided with means for preventing the third duct from pinching off or collapsing.

3. The wearable speaker system according to claim 1 wherein the first, second and third ducts comprise:

multilayered tubes for minimizing air flow resistance and for increasing compressed air flow capacity through the flexible ducts.

4. The wearable speaker system according to claim 1 further comprising:

a second flexible sleeve enclosing the first duct wherein the second flexible sleeve is provided with means for preventing the first duct from pinching off or collapsing.

5. The wearable speaker system according to claim 1 further comprising:

a third flexible sleeve enclosing the second duct wherein the third flexible sleeve is provided with means for preventing the second duct from pinching off or collapsing.

6. The wearable speaker system according to claim 2 wherein the means for preventing the third duct from pinching off or collapsing comprises:

a coiled spring surrounding the third duct.

7. The wearable speaker system according to claim 2 wherein the means for preventing the third duct from pinching off or collapsing comprises:

a rotating friction chain surrounding the third duct.

8. The wearable speaker according to claim 1 wherein the third duct acoustically connects the second housing to the third housing.

9. The wearable speaker according to claim 1 wherein the third duct acoustically connects the first housing to the fourth housing.

10. The wearable speaker system according to claim 1 wherein the first passive radiator further comprises a diaphragm that covers a side of the first housing.

11. The wearable speaker system according to claim 1 wherein the second passive radiator further comprises a diaphragm that covers a side of the fourth housing.

12. The wearable system according to claim 1 wherein the first duct, the second duct and the third duct comprises a flexible duct.

13. The wearable system according to claim 1 wherein the first duct, the second duct and the third duct comprises a rigid duct.

14. The wearable system according to claim 1 wherein the first duct, the second duct and the third duct comprises a passageway.

* * * * *